US011678776B2

(12) United States Patent
Trampolski

(10) Patent No.: US 11,678,776 B2
(45) Date of Patent: Jun. 20, 2023

(54) STUB ROLL DISPENSER SYSTEM

(71) Applicant: Dispensing Dynamics International, Inc., San Marcos, CA (US)

(72) Inventor: Alexander Trampolski, Eastvale, CA (US)

(73) Assignee: Dispensing Dynamics International, Inc., San Marcos, CA (US)

( * ) Notice: Subject to any disclaimer, the term of this patent is extended or adjusted under 35 U.S.C. 154(b) by 6 days.

(21) Appl. No.: 17/384,278

(22) Filed: Jul. 23, 2021

(65) Prior Publication Data

US 2022/0000322 A1 Jan. 6, 2022

Related U.S. Application Data

(63) Continuation of application No. 16/294,014, filed on Mar. 6, 2019, now Pat. No. 11,089,920.

(60) Provisional application No. 62/640,535, filed on Mar. 8, 2018.

(51) Int. Cl.
*A47K 10/36* (2006.01)
*A47K 10/32* (2006.01)

(52) U.S. Cl.
CPC .. *A47K 10/3687* (2013.01); *A47K 2010/3253* (2013.01)

(58) Field of Classification Search
CPC ..... A47K 10/3687; A47K 2010/3253
See application file for complete search history.

(56) References Cited

U.S. PATENT DOCUMENTS

| | | | |
|---|---|---|---|
| 1,025,312 | A | 5/1912 | Rydquist |
| 1,026,128 | A | 5/1912 | Rydquist |
| 1,084,598 | A | 1/1914 | Antone |
| 1,860,668 | A | 5/1932 | Gillet |
| 2,169,399 | A | 8/1939 | Steiner |
| 2,930,664 | A | 3/1960 | Liebisch |
| 2,957,636 | A | 10/1960 | Lesavoy |
| 3,010,669 | A | 11/1961 | Layton |
| 3,107,957 | A | 10/1963 | Batlas et al. |
| 3,140,060 | A | 7/1964 | Layton et al. |
| 3,613,880 | A | 10/1971 | Perrin |
| 3,628,743 | A | 12/1971 | Bastian et al. |
| 3,672,552 | A | 6/1972 | Krueger et al. |
| 3,917,191 | A | 11/1975 | Graham, Jr. et al. |

(Continued)

FOREIGN PATENT DOCUMENTS

| | | | |
|---|---|---|---|
| EP | 0933054 | A2 | 8/1999 |
| GB | 794825 | A | 5/1958 |

(Continued)

OTHER PUBLICATIONS

"The International Dispensing System" Catalog, Dispensing Dynamics International, 2010, pp. 1-60.

(Continued)

*Primary Examiner* — Sang K Kim
*Assistant Examiner* — Nathaniel L Adams
(74) *Attorney, Agent, or Firm* — Knobbe, Martens, Olson and Bear, LLP

(57) ABSTRACT

Various tissue dispensers are disclosed. The tissue dispenser can hold a main roll of tissue and a stub roll of tissue. In response to the tissue of the stub roll being exhausted, an advance system of the tissue dispenser can automatically transition the tissue dispenser to dispensing tissue material of the main roll.

22 Claims, 10 Drawing Sheets

(56) References Cited

U.S. PATENT DOCUMENTS

| | | | | |
|---|---|---|---|---|
| 4,013,236 | A | 3/1977 | Perrin | |
| 4,106,684 | A | 8/1978 | Hartbauer et al. | |
| 4,165,138 | A * | 8/1979 | Hedge | A47K 10/3656 242/564.4 |
| 4,192,442 | A | 3/1980 | Bastian et al. | |
| 4,203,562 | A | 5/1980 | DeLuca et al. | |
| 4,204,180 | A | 5/1980 | Usui et al. | |
| 4,317,547 | A | 3/1982 | Graham, Jr. et al. | |
| 4,358,169 | A | 11/1982 | Filipowicz et al. | |
| 4,403,748 | A | 9/1983 | Cornell | |
| 4,699,304 | A | 10/1987 | Voss et al. | |
| 4,756,485 | A | 7/1988 | Bastian et al. | |
| 4,807,824 | A | 2/1989 | Gains et al. | |
| 4,844,361 | A | 7/1989 | Granger | |
| 4,846,412 | A | 7/1989 | Morand | |
| 5,244,161 | A | 9/1993 | Wirtz-Odenthal | |
| 5,294,192 | A | 3/1994 | Omdoll et al. | |
| 5,302,167 | A | 4/1994 | Kley et al. | |
| 5,400,982 | A | 3/1995 | Collins | |
| 5,884,861 | A | 3/1999 | Hosomi et al. | |
| 5,979,822 | A | 11/1999 | Morand et al. | |
| 6,145,779 | A | 11/2000 | Johnson et al. | |
| 6,152,397 | A | 11/2000 | Purcell | |
| 6,224,010 | B1 | 5/2001 | Morand | |
| 6,237,871 | B1 | 5/2001 | Morand et al. | |
| 6,314,850 | B1 | 11/2001 | Morand | |
| 6,793,170 | B2 | 9/2004 | Denen et al. | |
| 6,871,815 | B2 | 3/2005 | Moody et al. | |
| 7,168,602 | B2 | 1/2007 | Broehl | |
| 7,270,292 | B2 | 9/2007 | Rasmussen | |
| 7,570,067 | B2 | 8/2009 | Denen et al. | |
| 7,946,522 | B2 | 5/2011 | Lewis et al. | |
| 8,282,033 | B2 | 10/2012 | Achton | |
| 8,777,149 | B2 | 7/2014 | Goeking et al. | |
| 9,326,647 | B2 | 5/2016 | Larson et al. | |
| 9,326,648 | B2 | 5/2016 | Trampolski | |
| 10,045,669 | B2 | 8/2018 | Morand | |
| 10,722,081 | B2 | 7/2020 | Achton | |
| 10,966,578 | B2 | 4/2021 | Zimmermann et al. | |
| 11,089,920 | B2 | 8/2021 | Trampolski | |
| 11,241,124 | B2 | 2/2022 | Keily et al. | |
| 2003/0167893 | A1 | 9/2003 | Morris et al. | |
| 2012/0138723 | A1 | 6/2012 | Lewis et al. | |
| 2014/0367507 | A1 | 12/2014 | Trampolski | |
| 2016/0242603 | A1 | 8/2016 | Cvjetkovic | |
| 2020/0147984 | A1 | 5/2020 | Weeks et al. | |
| 2020/0323401 | A1 | 10/2020 | Keiley et al. | |
| 2021/0032063 | A1 | 2/2021 | Janek et al. | |
| 2022/0240733 | A1 | 8/2022 | Keily et al. | |

FOREIGN PATENT DOCUMENTS

| | | | | |
|---|---|---|---|---|
| GB | 1114891 | A | 5/1968 | |
| KR | 2002-0025446 | A | 4/2002 | |
| WO | WO 02/100232 | A1 | 12/2002 | |
| WO | WO 2009/150197 | A1 | 12/2009 | |
| WO | WO 2010/046662 | A1 | 4/2010 | |
| WO | WO 2014/200624 | A1 | 12/2014 | |
| WO | WO 2019/173477 | A1 | 9/2019 | |
| WO | WO 2020/210541 | A1 | 10/2020 | |
| WO | WO-2020210541 | A1 * | 10/2020 | A47K 10/3625 |

OTHER PUBLICATIONS

"GP Towlmastr® Brown Series 2000 Roll Towel (X-Series). 7.4 × 450 ft. Brown. 12 rolls.", Baumann Paper Company, Inc., accessed Mar. 18, 2020, in 2 pages. URL: https://www.baumannpaper.com/show_product/GEP-19724.

International Search Report and Written Opinion, re PCT Application No. PCT/US2019/020958 dated Jun. 25, 2019.

International Preliminary Report on Patentability, re PCT Application No. PCT/US2019/020958 dated Sep. 17, 2020.

* cited by examiner

STUB ROLL DISPENSER SYSTEM

CROSS REFERENCE

This application is a continuation of U.S. patent application Ser. No. 16/294,014, filed Mar. 6, 2019, which claims the priority benefit under 35 U.S.C. § 119 of U.S. Patent Application No. 62/640,535, filed Mar. 8, 2018, the entireties of which are hereby incorporated by reference herein.

BACKGROUND

Field

The field of the invention generally relates to tissue and towel dispensers.

Description of Certain Related Art

Tissue dispensers provide a convenient storage system for rolls of fibrous paper products or tissue paper (e.g., bathroom tissue, paper towels, or other). Tissue dispensers are generally designed to hold one or multiple rolls of tissue paper and to provide a dispensing mechanism. The dispensing mechanism generally allows a user to easily retrieve a length of the roll. As one length of tissue paper is retrieved from the dispensing mechanism, an additional length becomes available for retrieval from the roll. This process slowly unrolls the entirety of the length of the roll of tissue paper. To reduce waste, the roll is generally left in the dispenser until it is completely exhausted. The exhausted roll can be replaced with a new roll and the process repeated.

SUMMARY OF CERTAIN FEATURES

In some instances, it is desirable to replace the roll before it becomes completely exhausted. For example, running out of tissue in an unexpected moment can be problematic for a user. This can be especially the case where the user is not able or allowed to replace the exhausted roll with a fresh roll (e.g., a locked or otherwise secured tissue dispenser). One situation in which this can occur is in a bathroom with a regular (e.g., daily or weekly) maintenance schedule. Leaving a partially depleted roll (called a "stub roll") in the tissue dispenser until the next maintenance period risks exhausting the roll in the interim period. On the other hand, replacing the stub roll prematurely wastes the tissue remaining thereon.

Previous attempts to address the stub roll problem include leaving the stub roll in a location proximate the tissue dispenser that remains accessible to the user. While straightforward, this solution fails to provide any convenient way of dispensing the tissue from the stub roll. This solution also does not ensure that the stub roll will be used by a user (e.g., the user may favor use of the roll in the tissue dispenser). Furthermore, the stub roll can be misplaced, stolen, thrown away, wetted, or otherwise made unusable. Thus, there is a need for an alternative solution.

Other previous approaches to the problem of switching a tissue dispenser to distribute tissue from a stub roll to distribute tissue from a main roll have various disadvantages. For example, previous approaches include a roller having a plurality of grooves located therein. The surface area of the roller available to engage with the tissue material is thus reduced and can lead to tearing of the tissue material. In some designs, the roller also acts as a turning point for the tissue distribution mechanism. This arrangement can be disadvantageous because the tissue material is subject to increased force at the turning points, which can lead to tearing of the tissue material.

Certain previous approaches include one or more extensions that can engage within the plurality of grooves on the roller and/or be supported on the tissue material of the stub roll. The extensions can be attached to a lever mechanism. The extensions can support a transfer lever. However, the transfer lever can rest in contact with the extensions and transfer additional force (e.g., from a spring or weight of the transfer lever) onto the tissue material. This arrangement can increase the overall friction in a tissue distribution mechanism and lead to tearing of the tissue material. For example, the increased friction can lead to tabbing and/or a shorter tail of the tissue material. "Tabbing" can refer to small strips of tissue being dispensed to a user, rather than a sheet of tissue material. A "tail" can be a length of tissue material hanging out of a dispenser that is available for a user to grasp and pull. A short tail can be inconvenient for users since there is less tissue material to grasp.

In certain previous approaches, the one or more extensions that can engage within the plurality of grooves on the roller and/or be supported on the tissue material of the stub roll. The extensions can be attached to a transfer roller. The extensions can contact the tissue material and transfer additional frictional force onto the tissue material. This arrangement can increase the overall friction in a tissue distribution mechanism and lead to problems, such as tabbing and/or a shorter tail of the tissue material.

At least some of the aforementioned issues, or other issues, are overcome by various implementations of the solutions described herein. One aspect of some implementations of a tissue dispenser described herein provides the benefit of exhausting the stub roll before beginning dispensing of a main roll of the tissue dispenser. Another aspect of some implementations of the tissue dispenser is that the tissue of the stub roll is accessible in the same location of the tissue dispenser as the tissue of the main roll. A further aspect of some implementations of the tissue dispenser is that as the stub roll is exhausted, the tissue dispenser automatically switches to the main roll. Still another aspect of some implementations of the tissue dispenser is that the switch from the main roll to the stub roll is not noticeable to the user. Yet another aspect of some implementations of the tissue dispenser is a stub roll compartment for containing and dispensing the stub roll (e.g., within an outer casing to the tissue dispenser).

In another aspect of some implementations of a tissue dispenser, the tissue dispenser includes a stop cover. The stop cover can include a plurality of riders and can be disposed over a plurality of channels. The tissue of the stub roll can support the riders over the plurality of channels. The stop cover can engage with the tissue material under the force due to gravity. In certain implementations, the stop cover includes no spring to place additional force on the tissue material. The channels can be disposed in an upper surface (e.g., horizontal surface) of an advance system for distributing the tissue material of a main roll and the stub roll. In certain implementations, the upper surface is not a roller or drum.

In another aspect of some implementations of a tissue dispenser, the tissue dispenser includes a front cover. The front cover can engage with the stop cover when the stop cover is supported over the plurality of channels. The engagement of the front cover and the stop cover can position the front cover away from a drum of the advance system. Removal of the tissue material from over the channels allows the riders of the stop cover to fall into the channels. This allows the front cover to rotate to engage tissue of the main roll into the advance system. In certain implementations, the front cover engages with the stop cover such that substantially no additional force from the front cover is transferred to the tissue material between the riders and the channels. For example, the front cover can engage with the stop cover at a generally orthogonal angle relative to the upper surface. This arrangement can reduce friction within the advance system and/or increase the reliability of the tissue dispenser.

In another aspect, the front cover applies no force to the tissue material of the stub roll in the first configuration. In another aspect, the stop cover is oriented generally horizontally and the front cover is oriented generally vertically. In another aspect, the channels are disposed in an upper surface of the advance system. In another aspect, the only load on the tissue material of the stub roll over the channels in the first configuration is due to the weight of the stop cover. In another aspect, the stop cover is not spring-loaded into engagement with the tissue material of the stub roll. In another aspect, stop cover does not comprise a roller for engaging with the tissue material of the stub roll. In another aspect, the second end of the front cover applies no load against the tissue material of the main roll and no load against the tissue material of the stub roll in the first configuration. In another aspect, the drum does not include circumferential grooves sized to receive the fingers of the stop cover. In another aspect, the stop cover never contacts the drum.

In another aspect, a tissue dispenser has an advance system for dispensing tissue material of a stub roll and tissue material of a main roll. The tissue dispenser has a stub roll dispenser for switching the tissue dispenser to dispense the tissue material of the main roll when the tissue material of the stub roll is exhausted. The stub roll dispenser has a front cover to engage the tissue material of the main roll with a drum of the advance system. A stop cover supports the tissue material of the stub roll engages with the front cover to offset (e.g., space apart) the front cover from the drum. The tissue material of the stub roll is disposed around the drum and fed through the advance system and the tissue material of the main roll is disposed between the front cover and the drum. When the stub roll is exhausted, the stop cover shifts downward and disengages from the front cover, the front cover engages the tissue material of the main roll with the drum, and the tissue material of the main roll is thereafter fed through the advance system.

In another aspect, the stub roll dispenser has one or more channels in an upper surface. The stop cover has one or more fingers corresponding to and aligned with the channels. The upper surface supports the tissue material of the stub roll where the tissue material of the stub roll supports the stop cover.

In another aspect, the stop cover is oriented generally horizontally and the front cover is oriented generally vertically.

In another aspect, some or substantially the only load on the tissue material of the stub roll over the channels is due to the weight of the stop cover.

In another aspect, the stop cover has a first end pivotably coupled with a frame of the stub roll dispenser and the front cover comprises a spring to bias the front cover towards the drum.

BRIEF DESCRIPTION OF THE DRAWINGS

Various features of are disclosed herein are described below with reference to the drawings of certain embodiments. The illustrated embodiments are intended to illustrate, but not to limit the present disclosure.

DETAILED DESCRIPTION OF CERTAIN EMBODIMENTS

Figure 1:
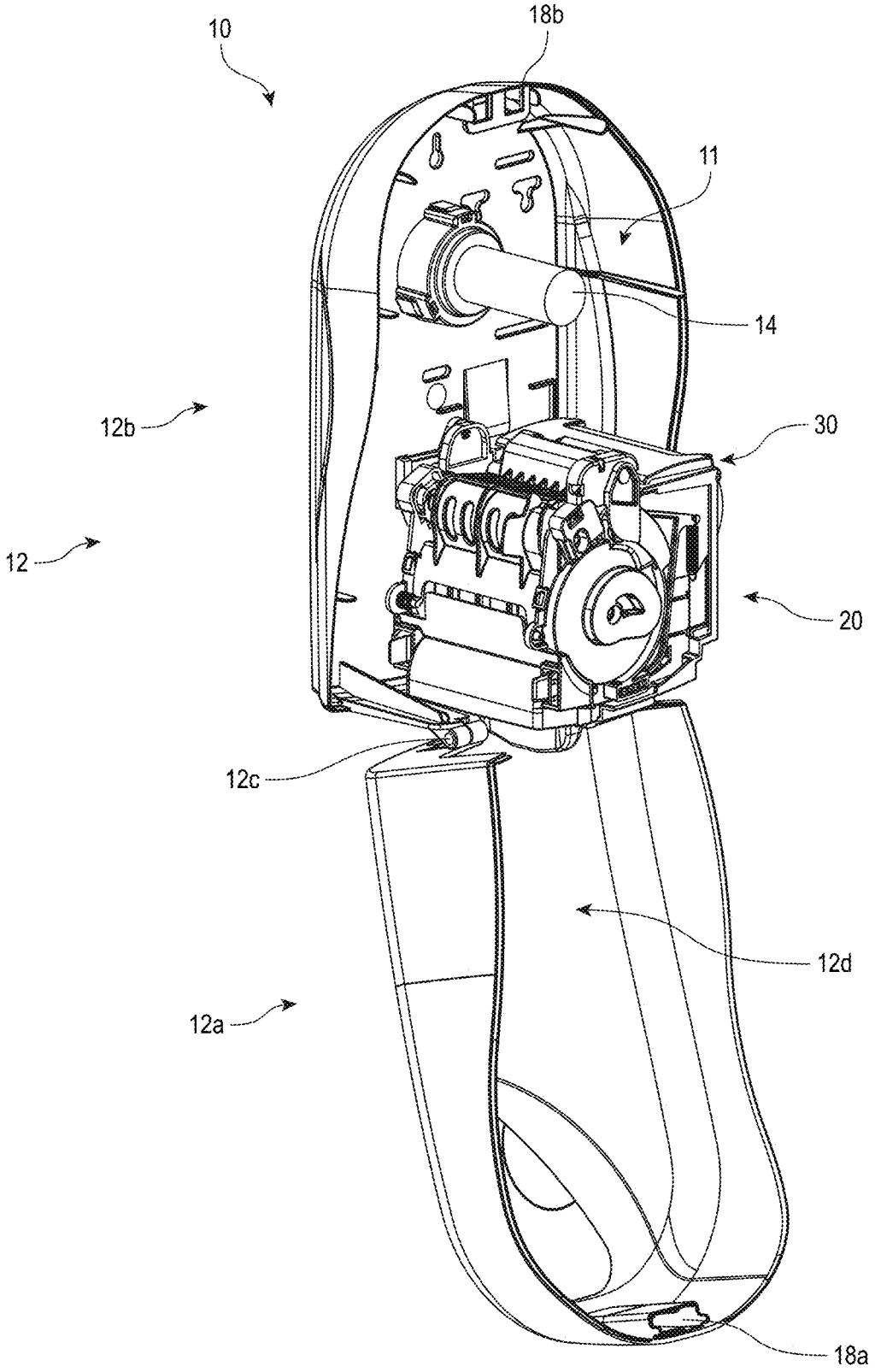
FIG. 1 is a perspective view of a tissue dispenser.

FIG. 1 illustrates a tissue dispenser 10 having an advance system 20. In some embodiments, the dispenser 10 can comprise a toilet paper dispenser, paper towel dispenser, facial tissue dispenser, wipes dispenser, or other type of tissue dispenser. The dispenser 10 can be configured to dispense product that is wound on a core, such as a roll of paper tissue. In several embodiments, as described in more detail below, the dispenser 10 is configured to switch (e.g., sequentially and/or automatically) between dispensing product from a stub roll to dispensing product from a main roll. In some implementations, the dispenser 10 is configured to dispense, in series, tissue material from the stub roll and then tissue material from the main roll. In certain variants, the dispenser 10 is configured to avoid concurrently dispensing tissue material from the stub and main rolls. This can reduce waste and/or can mask from a user that multiple rolls of tissue are present. The tissue dispenser 10 can include an outer casing 12. The outer casing 12 can be made of plastic, metal or any suitable material (e.g., ABS polyethylene, polypropylene and/or other polymers). The casing 12 can form an enclosure about the advance system 20. The casing 12 can include a front 12*a* and a back 12*b*. The back 12*b* can include a plurality of various holes and connector mechanisms for engaging with a wall or other structure for mounting the tissue dispenser (e.g., in a bathroom or other location). The front 12*a* can be hingedly attached with the rear 12*b*, for example, at a hinge 12*c* of the casing 12. The casing 12 can include a locking mechanism with a front locking mechanism 18*a* and a rear locking mechanism 18*b*. The rear locking mechanism 18*b* can engage with the front locking mechanism 18*a* to securely close the casing 12. For example, the locking mechanism 18*a*, 18*b* can require opening with a key or other specialized tool that limits access to the inside of the casing 12.

Figure 2:
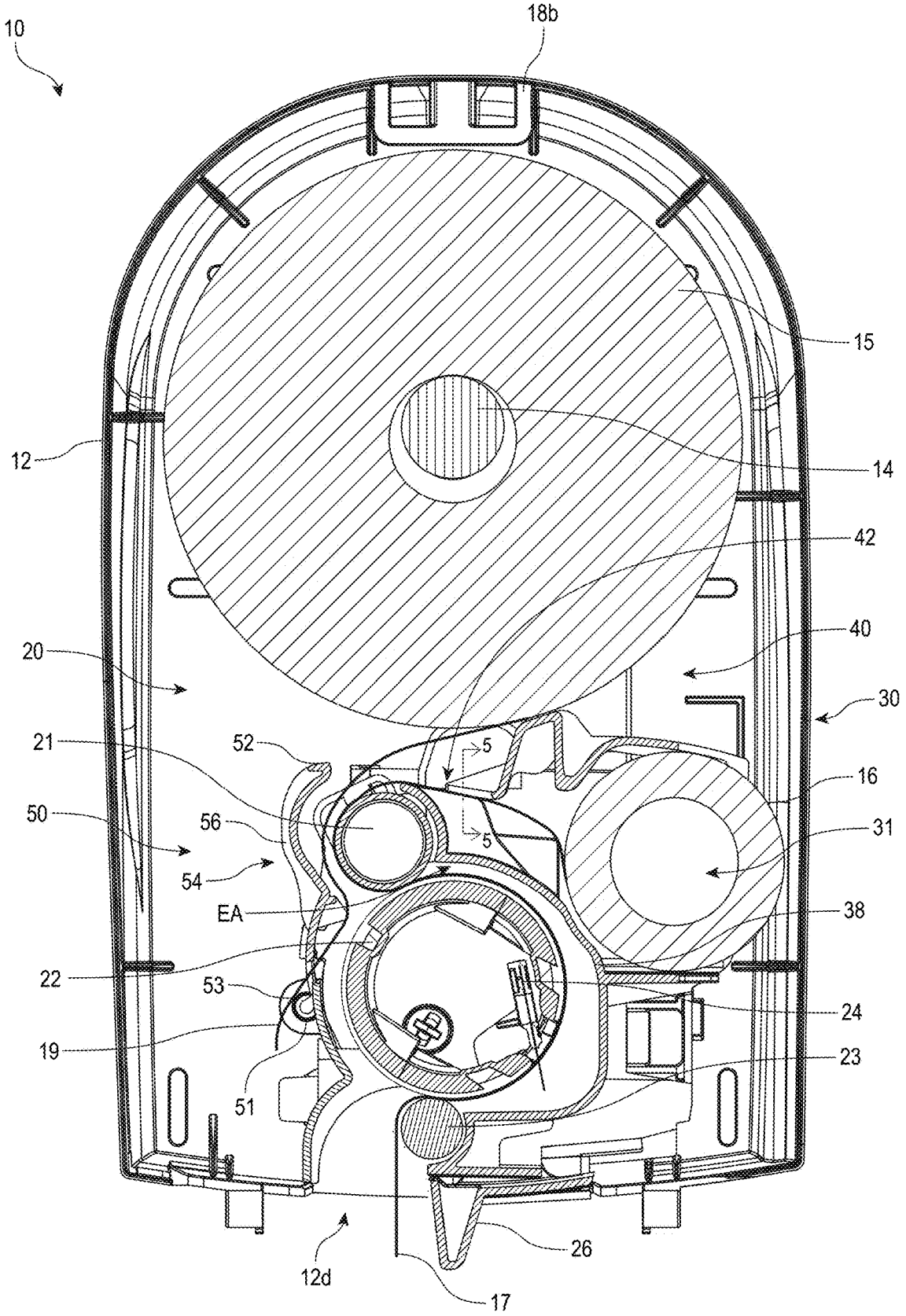
FIG. 2 is a front section view of the tissue dispenser.

As illustrated in FIGS. 1 and 2, the casing 12 can include a compartment 11 for containing a main roll of tissue 15. The main roll 15 fits into the main roll compartment 11 of the tissue dispenser 10. The compartment 11 can include a support shaft 14. In some implementations, the support shaft 14 can extend from the casing 12, such as from the back 12*b*. The support shaft 14 provides support to the main roll 15 so that the main roll 15 can rotate as the tissue of the main roll 15 is dispensed through the advance system 20. A lower end of the casing 12 can include an opening 12*d* providing access to the advance system 20. The tissue of the main roll 15 can be delivered to the user through the advance system 20 (e.g., at the opening 12*d*). A tail end 19 of the main roll 15 can be received within the advance system 20 and advanced therethrough to the user (e.g., at the opening 12*d*).

The advance system 20 can include a first drum 21, a second drum 22, and/or a third drum 23. The first, second, and third drums 21-23 can each be rotatable about a respective axis. The tissue can be threaded through the advance system 20 by wrapping at least partially around the first, second, and third drums 21-23. The tissue can engage with a surface of one or more of the first, second, and/or third drums 21-23. In some implementations, the surfaces of the first, second, and/or third drums 21-23 can be at least partially rubberized to provide frictional engagement between the tissue and the drum. The first, second and/or third drums can be nip rollers. The first, second and third drums 21-23 can tension the tissue as it moves through the advance system 20. This can facilitate or ensure that the tissue unrolls evenly and continuously through the advance system 20. The tail end 19 of the main roll 15 can be advanced through the advance system 20 and accessible to the user at the opening 12*d*. In certain implementations, the engagement angle between the drums 21, 22 can be in an upward direction EA, as shown in FIG. 2. This allows for a longer interface of the tissue material with the drum 22 compared to a downward direction. A longer interface with the tissue can provide increased tensioning of the tissue and/or reduce tearing of the tissue. This can facilitate cutting of the tissue and increase the overall reliability of the advance system 20. In various embodiments, an outer surface of the second drum 22 includes a grip-enhancing feature, such as a thermoplastic elastomer (TPE) material.

The second drum 22 can be rotated by the drive mechanism, such as a ratchet system (not shown). The ratchet system can be operated by an actuator, such as a knob or push bar 26. Rotation of the second drum 22 can advance the tissue through the advance system 20. The ratchet system can facilitate or ensure that the advance system 20 will advance the tissue towards the user while inhibiting or preventing the tissue from moving backwards or otherwise falling out of the advance system 20 (and becoming inaccessible to the user).

In some implementations, the tissue of the main roll 15 is unperforated. Unperforated tissue can provide advantages over pre-perforated tissue rolls because the tissue material can be uniformly unrolled and advanced through the advance system 20. This increases the overall reliability of the tissue dispenser 10. In some implementations, the second drum 22 can include a perforation mechanism 24 for perforating the tissue. Perforating the tissue makes it easier for a user to tear off a length of the tissue for use.

In some implementations, a force is applied to the length of tissue as it is grasped by a user and/or torn from the remaining tissue material. The force can advance the tissue through the advance system 20 and unroll it from the main roll 15 or a stub roll 16. The force can also operate the preformation mechanism 24 and/or rotate the first, second and/or third drums 21-23.

The advance system 20 can include a stub roll dispenser 30. Although disclosed herein in the context of a particular tissue dispenser and a particular advance system (e.g., advance system 20), the stub roll dispenser 30 disclosed herein can be applied variously to different types of tissue dispensers, towel dispensers, and advance systems. The stub roll dispenser 30 can include a stub roll compartment 31 for storing and dispensing the stub roll 16. The stub roll 16 can be a roll of tissue paper (e.g., a partially used main roll 15). The tissue of the stub roll 16 can be delivered to the user through the advance system 20 (e.g., instead of and/or in addition to the tissue of the main roll 15). A tail end 17 of the tissue of the stub roll 16 can be received within the advance system 20. The stub roll compartment 31 can be at least partially defined by a frame 38 of the advance system 20.

Figure 3:
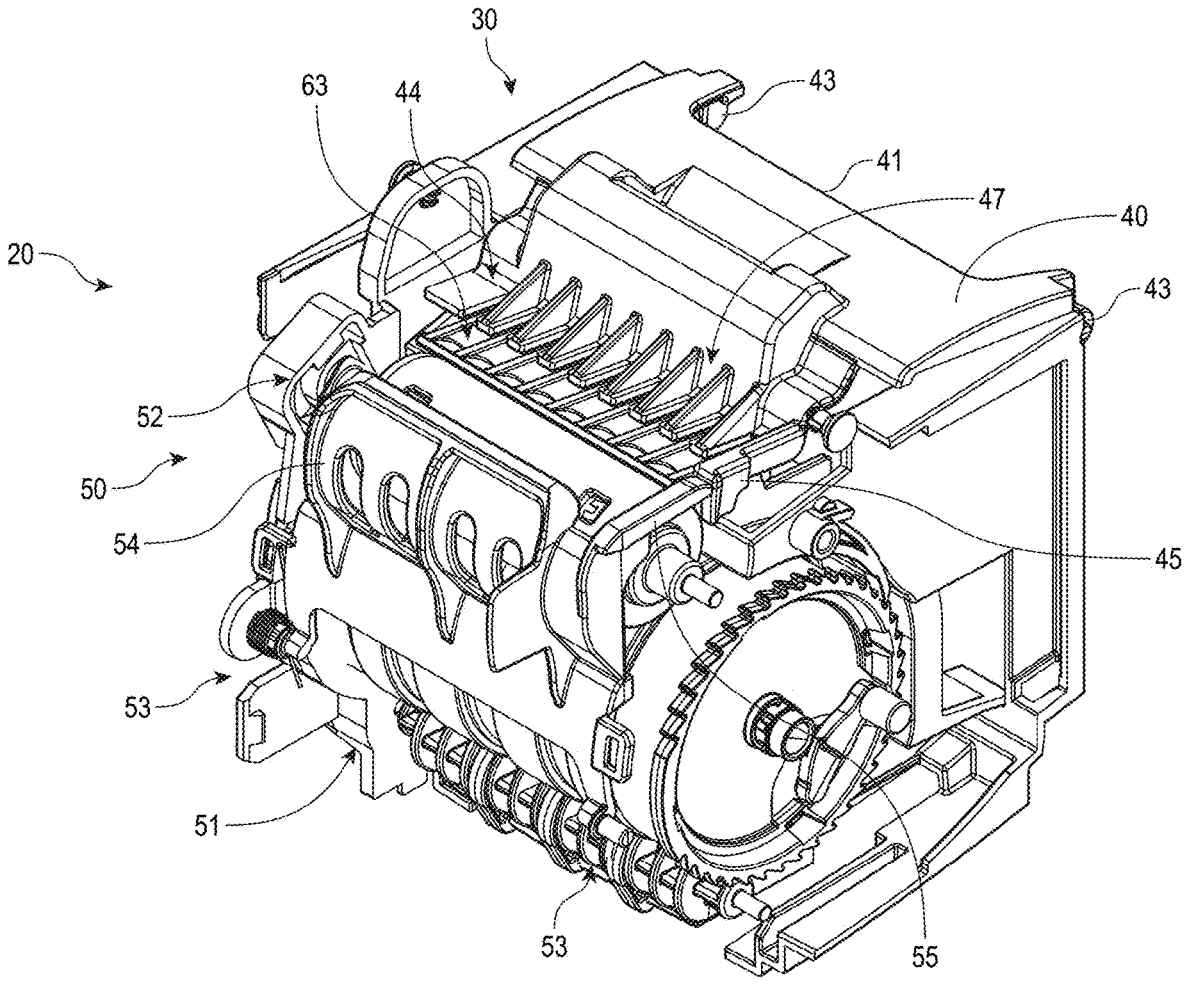
FIG. 3 is a perspective view of an advance system of the tissue dispenser, with some components omitted for purposes of presentation.
Figure 4:
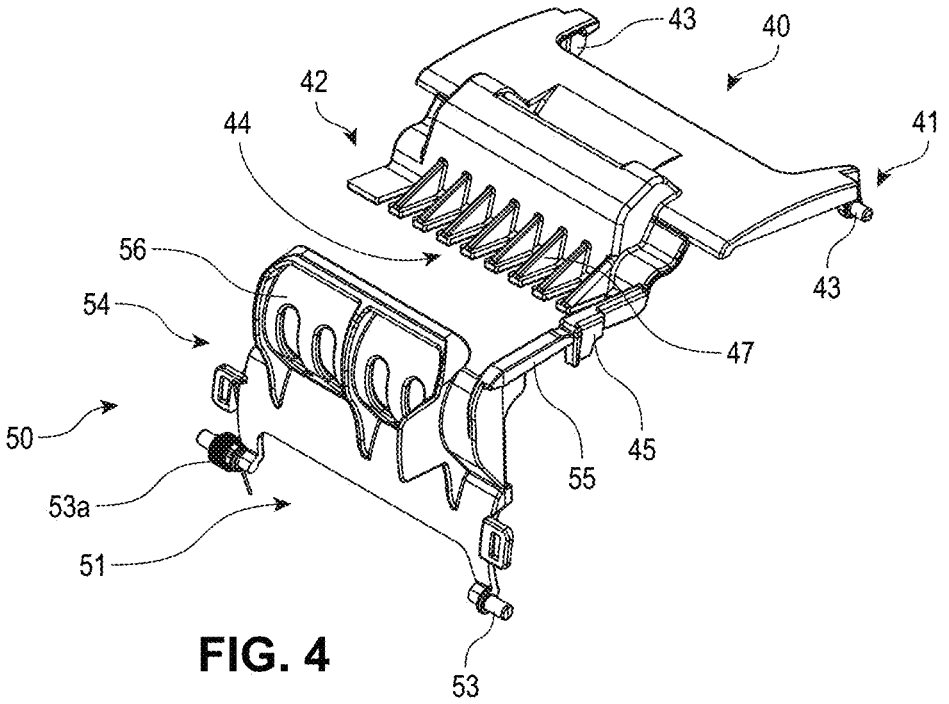
FIG. 4 is a perspective view of a stub roll dispenser of the tissue dispenser, with some components omitted for purposes of presentation.

The stub roll dispenser 30 can include a stop cover 40. The stop cover 40 can be pivotably coupled with the frame 38 at a first end 42, as shown in FIGS. 3 and 4. The first end 41 of the stop cover 40 can include hinges or pivots 43 to pivotably couple with the frame 38. The stop cover 40 can include a lip 44 at a second end 41. The second end 42 of the stop member 40 is extended away from the pivots 43 and the first end 41. The lip 44 can include a plurality of fingers or riders 47 at the second end 42. The second end 42 can include a stop member 45.

The stub roll dispenser 30 can include one or more channels 63. For example, the channels 63 can be within the frame 38. The channels 63 can correspond to (e.g., can be sized to receive) the riders 47 of the stop cover 40. The channels 63 can be defined between upright portions 65 dividing the channels 63. The riders 47 can fit within the channels 63 when the stop cover 40 is allowed to rotate under the force of gravity (see FIG. 7). In some embodiments (not shown), the stop cover 40 can include one or more riders 47 and channels 63 oriented between 0 and 90 degrees to the riders 47 and channels 63. The stop cover 40 can rotate towards the frame 38 (e.g., the riders 47 can rotate towards the channels 63) under the force of gravity by pivoting about the pivots 43. In some embodiments, the stop cover 40 can include a spring to bias the position of the stop cover 40. In certain implementations, the stop cover 40 is not a lever. In some variants, the stop cover 40 is configured to slide generally vertically towards the channels 63.

Figure 4A:
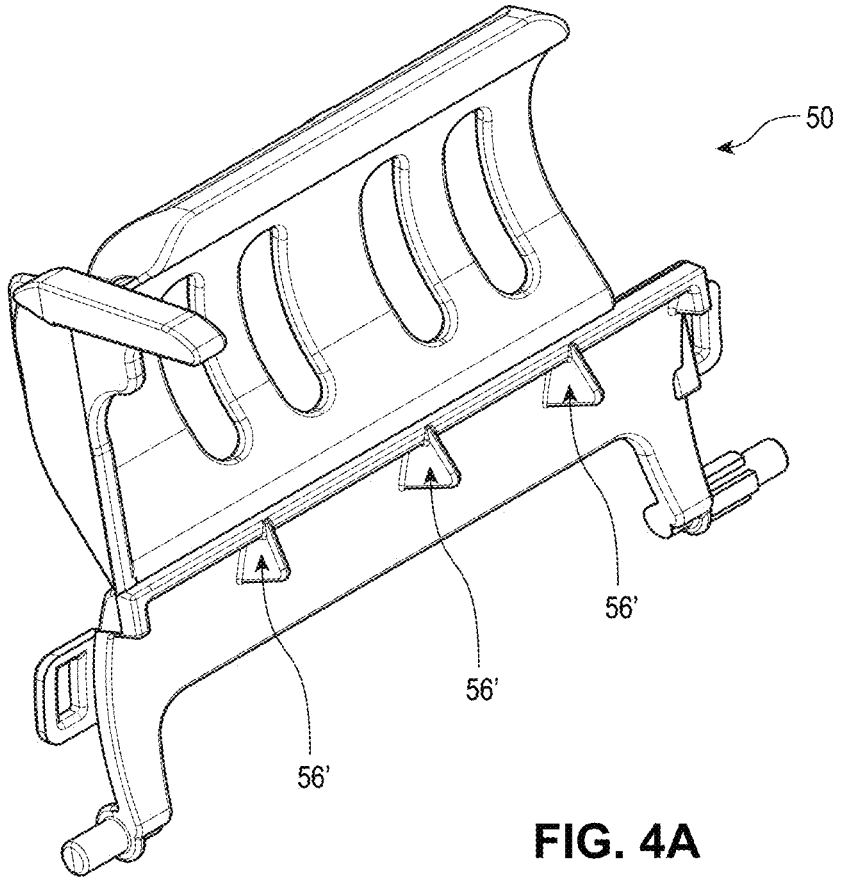
FIG. 4A is a perspective view of a front cover of the stub roll dispenser of FIG. 4.

The stub roll dispenser 30 can include a front cover 50. The front cover 50 can be pivotably coupled with the advance system 20 (e.g., with the frame 38). Some embodiments include pivot elements (e.g., holes) that are located on side panels of the dispenser 10, with the side panels being connected to the frame 38, such as by a snap fit. The front cover 50 can include pivots 53 at a first end 51. The pivots 53 can be spring-loaded (e.g., with a torsional spring 53*a*). The pivots 53 can bias the front cover 50 into the advance system 20 (e.g., into the first drum 21). A second end 52 of the front cover 50 can include an engagement portion 54. The engagement portion 54 can include a first portion 56, such as a curved portion. The curved portion 56 can generally correspond to the curvature of the first drum 21. In some embodiments, the engagement portion 54 includes a second portion 56' (see FIG. 4A). The second portion can be configured to engage with and/or push the tissue material of the main roll, such as against the drum 21 and/or the drum 22, as is discussed in more detail below. As illustrated, the second portion 56' can comprise a projection (e.g., a finger, wing, or otherwise) that extends toward the drum 21 and/or drum 22. Some embodiments have a plurality of second portions 56', such as two, three, four, or more.

Figure 6:
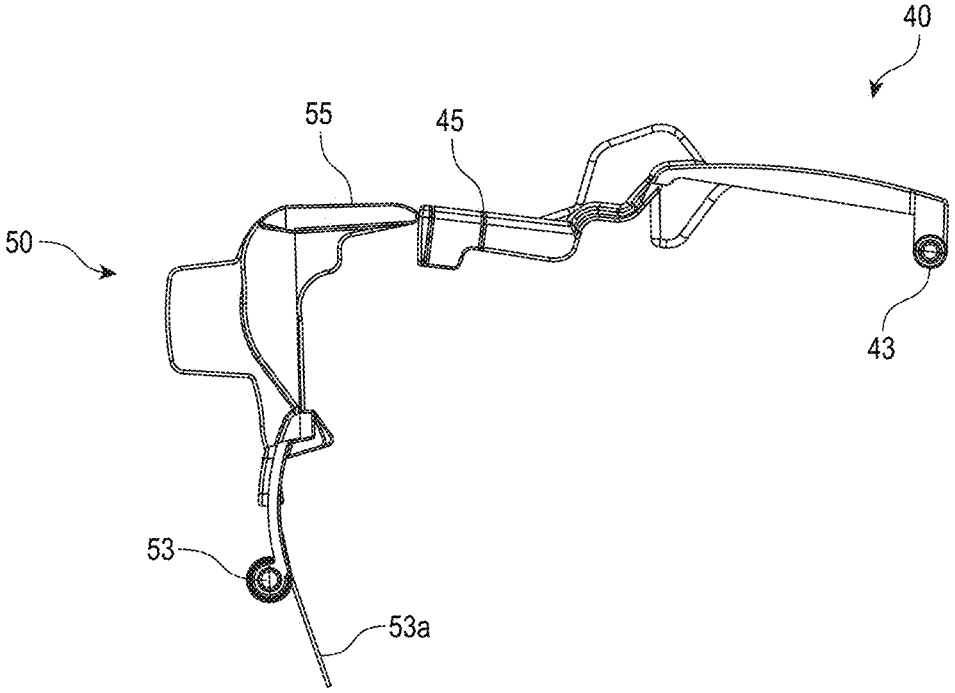
FIG. 6 is a side elevation view of FIG. 4 in a first configuration.

The second end 52 of the front cover 50 can include an extension member 55. The extension member 55 can extend towards the stop cover 40. The engagement extension 55 can engage with the stop member 45 on the stop cover 40 in a first configuration, as illustrated in FIG. 6. For example, the stop members of the stop cover 40 can provide a physical interference with the extension 55. The engagement of the extension member 55 and the stop member 45 can position the front cover 50 in the first configuration with the engagement portion 54 offset from the first drum 21. The extension member 55 can inhibit or prevent the front cover 50 from engaging with or rotating into (e.g., abutting against) the first drum 21. The tissue 19*a* of the main roll 15 can be disposed between the engagement portion 54 and the first drum 21. The tail end 19 can extend through the front cover 50 (e.g., between the pivots 53 at the first end 51) to remain clear of the advance system 20.

In some implementations, the extension member 55 can engage with the stop cover 40 in a manner that substantially no additional force in the vertical direction (e.g., towards the channels 63) is transferred from the front cover 50 to the stop cover 40. This can, in some variants, result in the force on the tissue material over the channels 63 being reduced or minimized. For example, the extension member 55 can engage with the stop member at an angle that is generally orthogonal to the channels 63. In another implementation, the extension member 55 can engage with the stop member 45 in a direction that is generally parallel with a radial line (e.g., a line passing through the pivots 43). In another implementation, stop cover is oriented generally horizontally and the front cover is oriented generally vertically.

Various embodiments described herein provide several advantages over previous approaches. For example, in certain implementations, the channels 63 are not on a roller and neither the front cover 50 nor the stop cover 40 engage with a roller. This can reduce or avoid issues caused by engagement with a roller with or without grooves, which can increase friction and/or pressure on the tissue material within the advance system 20. Another advantage is that, in certain embodiments, the force on the tissue material over the channels 63 is minimized by the engagement between the stop cover 40 and the front cover 50 (e.g., blocking of additional forces on the tissue material from the front cover 50). This can minimize tearing, tabbing, and/or forming a short tail by the advance system 20.

Furthermore, in certain implementations, the interaction of the advance system 20 in no way depends on the diameter of the stub roll. For example, the interaction of the stop cover 40 and the front cover 50, as well as the transition of the advance system 20 from advancing the tissue of the stub roll 16 to advancing the tissue of the main roll 15, in certain implementations, is in no way dependent on the diameter of the stub roll 16 or interaction of the advance system 20 therewith. This can increase the overall reliability of the tissue dispenser. The stub roll 16 can be loaded into the compartment 31 in either a top or bottom unrolling orientation.

Figure 5:
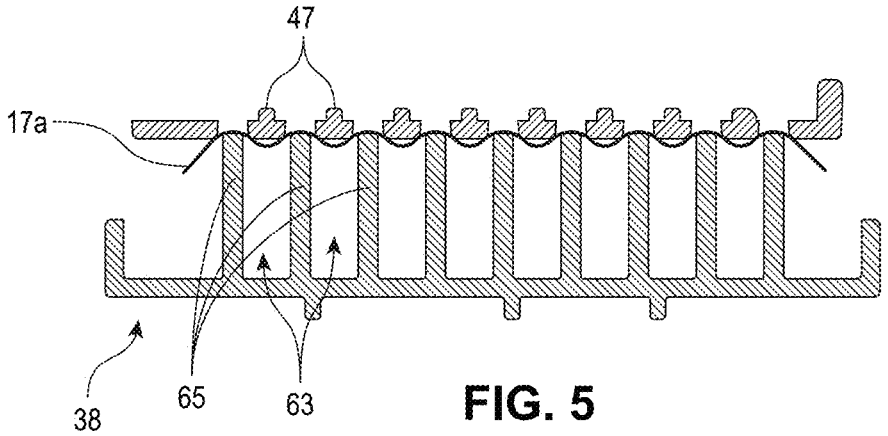
FIG. 5 is a section view taken along the line 5-5 in FIG. 2.

As shown in FIG. 5, the tissue 17*a* of the stub roll 16 can extend over the channels 63. For example, the tissue 17*a* can be supported on the tops of the upright portion 65. In some implementations, there is a sufficient number of channels 63 such that only a short segment (e.g., less than or equal to about ¼ inch) of tissue extends between each adjacent channel of the channels 63. In various embodiments, the tissue 17*a* of the stub roll supports the riders 47. The riders 47 can rest on the tissue 17*a* without falling completely into the channels 63, the stop cover 40 supported in place in the first configuration by the tissue 17*a*. In this manner, the riders 47 are inhibited or prevented from falling into channels 63 and thereby maintaining the position of the stop cover 40 and/or the physical interference between the stop member 45 and the extension 55. The riders 47 can also allow the tissue 17*a* to be pulled smoothly from the stub roll 16 and pass smoothly over the channels 63. The presence of the tissue over the channels 63 can position the stop cover 40 in the first configuration. In the first configuration, the stop member 45 can extend to contact the extension member 55.

In the first configuration, the tail end 17 of the stub roll 16 can be advanced through advance system 20. For example, the tail end 17 can be wrapped at least partially around the first drum, second drum and third drum and through the opening 12*d*. Thus, when the user grasps the tail end 17 and/or advances the push bar 26, the tissue 17*a* retrieved will be that of the stub roll 16. The user can be unaware that the stub roll 16 tissue (and not the main roll 15 tissue) is being distributed. Certain embodiments include an actuator, such as a push bar or knob, configured to switch the dispenser 10 from dispensing tissue material from the stub roll to dispensing tissue material from the main roll and/or vice versa.

Figure 7:
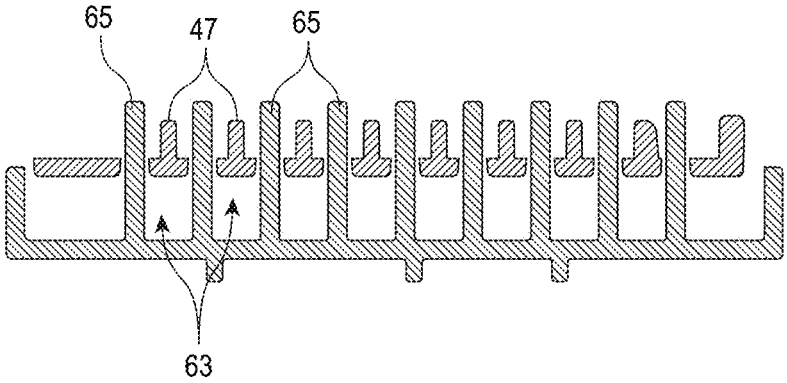
FIG. 7 shows FIG. 5 in a second configuration.
Figure 8:
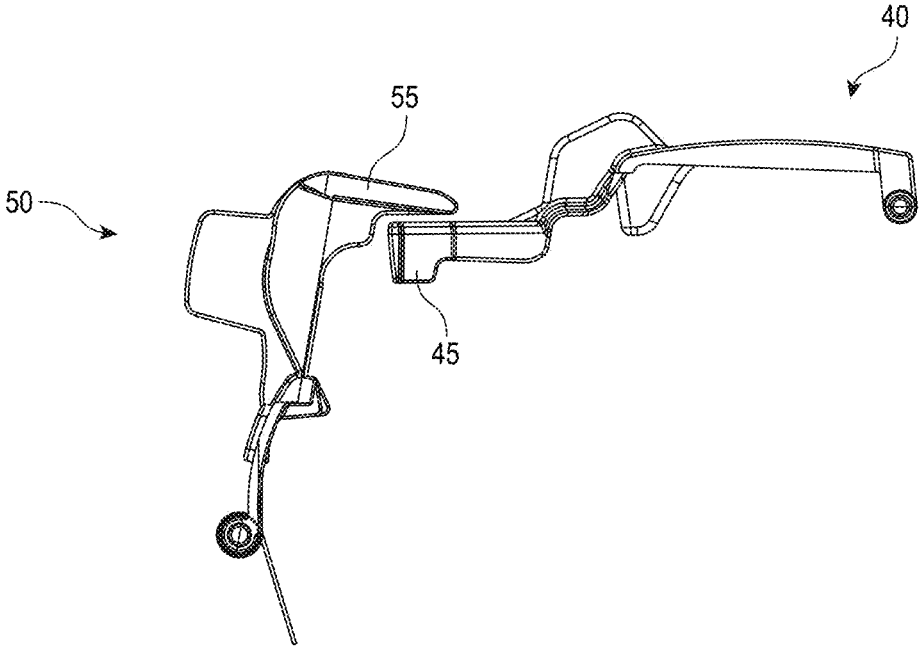
FIG. 8 shows FIG. 6 in the second configuration.

As the tissue of the stub roll 16 is exhausted (e.g., unrolled from the stub roll 16 and retrieved by the user through the advance system 20), the tissue 17*a* over the channels 63 is pulled away from the upright portions 65. When the tissue 17*a* is removed, the riders 47 can fall into the channels 63, as illustrated in FIG. 7. This allows the stop cover 40 (e.g., under the weight of the stop cover 40) to move into a second configuration. In the second configuration the riders 47 and/or other portions of the lip 44 and stop cover 40 can move relative to and/or rest on the frame 38 (e.g., within the channels 63). In response to movement of the stop cover 40, the physical interference with the extension 55 can be removed. The stop member 45 can be moved out of alignment with the extension member 55, as illustrated in FIG. 8. For example, the extension member 55 can no longer be engaged with the stop member 45. This can allow the front cover 50 to rotate (e.g., under the bias of the spring 53*a*) into the second configuration.

With the front cover 50 in the second configuration, the engagement portion 54 (e.g., the first portion 56) can move the tissue 19*a* of the main roll 15 near or into contact with the first drum 21 and/or the second drum 22. In some embodiments, the first portion 56 of the engagement portion 54 is spaced apart from and/or does not touch the first drum 21. For example, there can be a clearance, such as at least about 0.025", between the first portion 56 and the first drum 21 when the front cover 50 is pivoted toward the first drum 21 (e.g., in the second position). The tissue sheet can be thinner than the clearance, so might not be pressed against the first drum 21 by the first portion 56. In various embodiments, the first drum 21 is relatively slick (e.g., does not have TPE on the outside diameter), so may not reliably load or drive the sheet of tissue and/or can facilitate sliding the sheet of tissue relative to the first portion 56. On the other hand, the second drum 22 can be configured to reliably load or drive the sheet of tissue. For example, as mentioned above, the second drum 22 may have a grip-enhancing substance, such as TPE, on its outer surface. In certain embodiments, the second portion 56' of the engagement portion 54 pushes the sheet into engagement with the second drum 22. In certain implementations, the second portion 56' is received into a groove in the outer surface of the second drum 22 and/or each second portion 56' is received into a corresponding groove in the second drum 22. In some variants, when the front cover 50 is in the second configuration, the second portion 56' remains spaced apart from the second drum 22 and/or does not touch the second drum 22 and/or is configured to be positioned at or go slightly below the outside diameter of the second drum 22. This can aid in engaging the sheet of tissue with the outside surface of the second drum 22 and/or sliding the sheet of tissue relative to the second portion 56' of the engagement portion 54.

In the second configuration, the main roll's tissue 19*a* and the tail end 19 can be drawn into the advance system 20. For example, the user retrieving the tail end 17 of the stub roll 16 can advance the tail end 19 of the main roll 15 into the advance system (e.g., by rotating the second drum 22). In other examples, the user can advance the tail end 19 into the advance system 20 using the advance bar 26. In this manner, the advance system 20 (also called a transition system) can transition from distributing the tissue of the stub roll 16 to distributing the tissue of the main roll 15.

Figure 9:
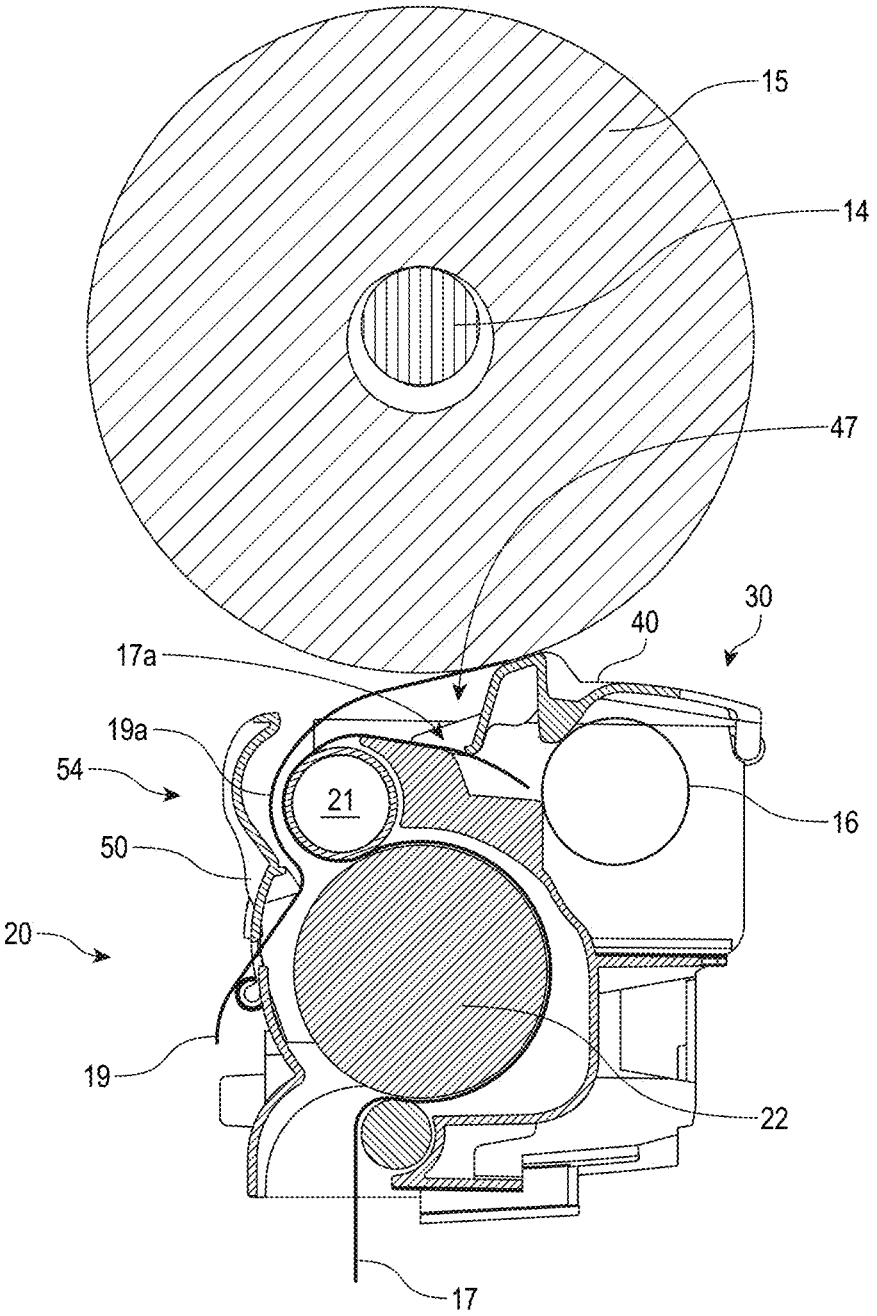
FIGS. 9-11 show the stub roll dispenser and progression of the tissue of the stub roll and tissue of a main roll through the advance system.
Figure 10:
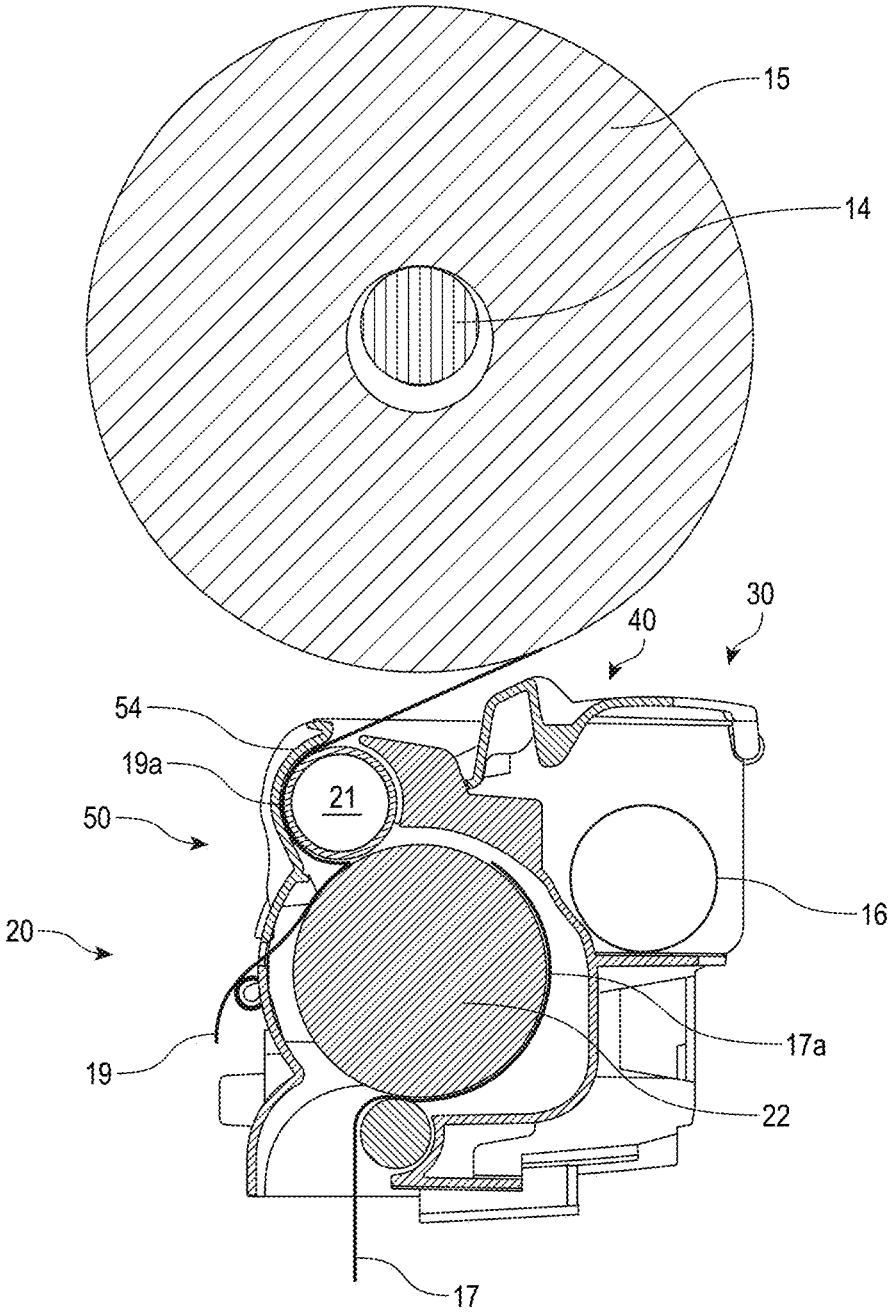
Figure 11:
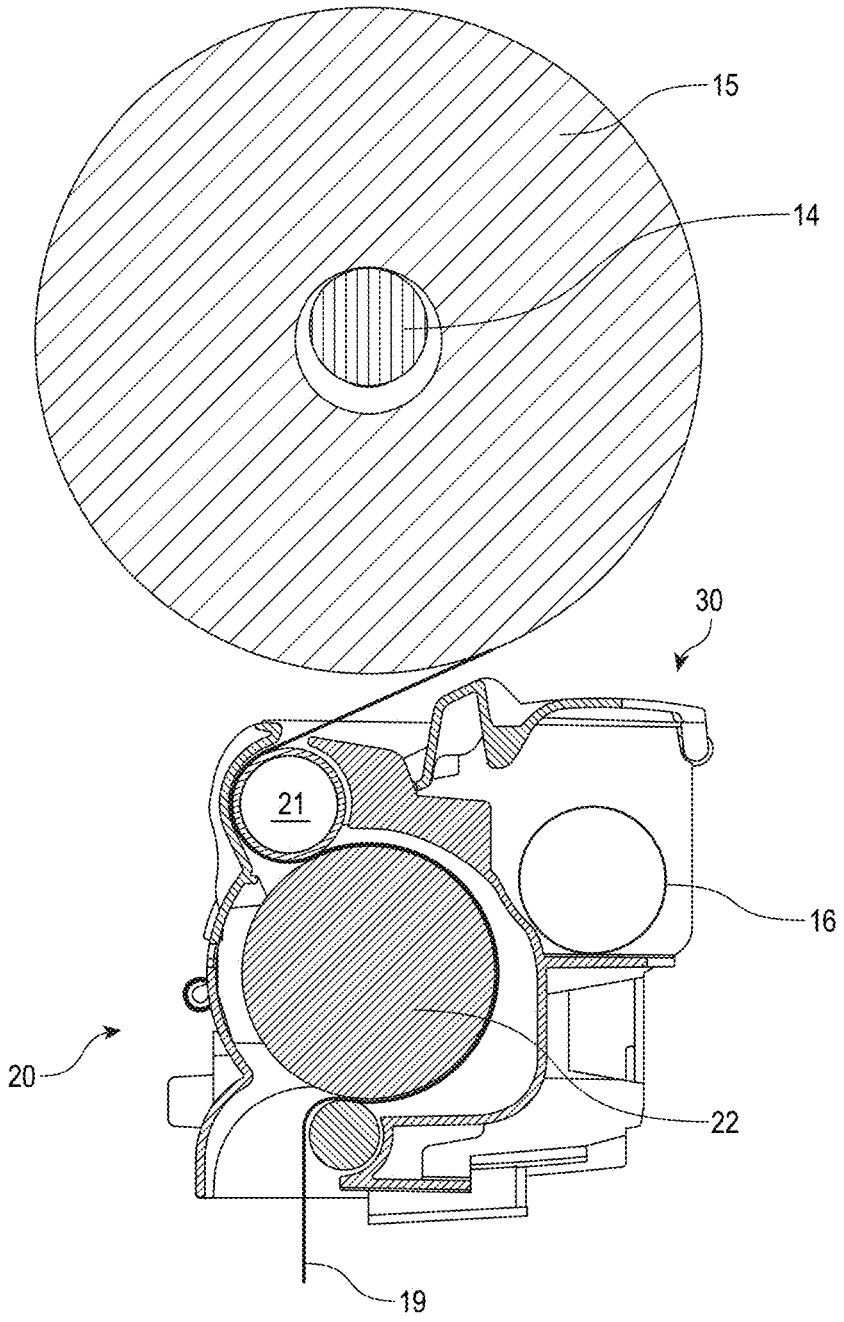

FIGS. 9-11 show the progression of the tissue of the stub roll 16 and tissue of a main roll 15 through the advance system 20. In FIG. 9, the stub roll dispenser 30 is in the first configuration. The riders 47 rest on the tissue 17*a* above the channels 63. The stop member 45 is aligned with the extension member 55 (not shown) and maintains the stop cover 40 and the front cover 50 in the first configuration. As shown in FIG. 9, during dispensation of tissue material from the stub roll, an end portion of the tissue material of the main roll can be disposed between the front cover 50 and the first drum 21 and/or the second drum 22.

As the stub roll 16 is exhausted, and the tissue 17*a* is pulled out from under the riders 47, as shown in FIG. 10, the stub roll dispenser 30 moves into the second configuration. The riders 47 fall into the channels 63, which misaligns the stop member 45 and the extension member 55 and/or removes the physical interference that was stopping the engagement portion 54 from rotating. In the second configuration, the front cover 50 (e.g., the second portion 56') moves the tissue 19*a* into contact with the first drum 21 and/or the second drum 22. The tissue 19*a* is drawn into the advance system 20 (e.g., by rotation of the drums 21-23). The remainder of the tissue material 17*a* is advanced through the advance system 20 (e.g., by the user). The tail end 19 of the main roll 15 is made available to the user in place of the tail end 17, as shown in FIG. 11. In various embodiments, the transition from the first configuration to the second configuration occurs automatically, such as without an additional action needed by a user.

Figure 12:
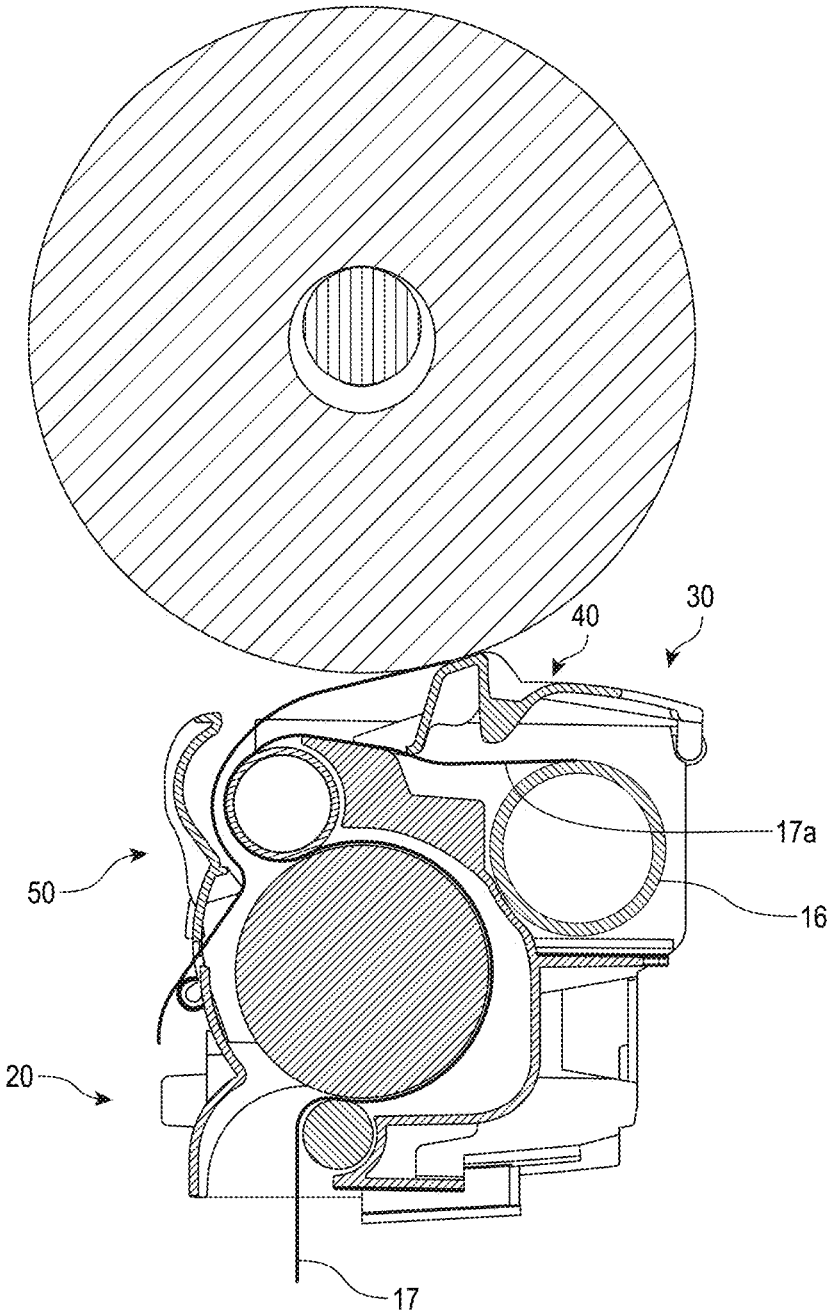
FIG. 12 shows the stub roll loaded in an alternative orientation.

The dispenser 10 can be configured to receive the stub roll 16 in various orientations. For example, as shown in FIG. 9, the stub roll 16 can be received with the tissue 17*a* unrolling from a bottom of the stub roll 16. As illustrated in FIG. 12, the stub roll 16 can be inserted into the compartment 31 in the opposite orientation in which the tissue 17*a* unrolls from a top of the stub roll 16. In some embodiments, a distance between the stop cover 40 and the frame 38 can be less than the diameter of a tube or core on which the tissue material of the stub roll 16 is wound. This will inhibit the stub roll tube or core from being pulled out of the compartment 31 or into the advance system 20.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

SUMMARY

Several illustrative embodiments of tissue dispensers and associated methods have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and other implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in other implementations. Also, the separation of various components in the implementations described above should not be understood as requiring such separation in all implementations, and it should be understood that the described components and systems can generally be integrated together in a single product or packaged into multiple products. Additionally, other implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. It is to be understood that not necessarily any or all such advantages are achieved in accordance with any particular embodiment of the inventions disclosed herein. No aspects of this disclosure are essential or indispensable. In many embodiments, the tissue dispensers may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of tissue dispensers and methods of installing and using the same have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

The following is claimed:

1. A dispenser configured to enable dispensing of one or more sheets of material and configured to transition from a first configuration to a second configuration, the dispenser comprising:

a main roll compartment configured to hold a main roll;

a stub roll compartment configured to hold a stub roll;

a frame having a plurality of upright portions and a plurality of channels formed by the plurality of upright portions, wherein the plurality of upright portions are configured to support material of the stub roll;

a stop cover pivotably coupled to the frame and having a plurality of fingers and a stop member positioned away from the plurality of fingers, the plurality of fingers aligned with the plurality of channels of the frame; and a front cover pivotably coupled to the frame and having an extension member;

wherein, when the dispenser is in the first configuration:

the extension member of the front cover contacts the stop member of the stop cover and does not contact the material of the main roll;

the plurality of fingers of the stop cover are supported by the material of the stub roll;

the material of the stub roll is supported on the plurality of upright portions of the frame; and the front cover applies substantially no load on the material of the stub roll; and wherein, when the dispenser is in the second configuration:

the plurality of fingers of the stop cover are positioned at least partially within the plurality of channels of the frame; and the dispenser is configured to enable dispensing of material of the main roll.

2. The dispenser of claim 1, wherein, when the dispenser is in the second configuration, the stop member of the stop cover does not contact the extension member of the front cover.

3. The dispenser of claim 1, wherein, when the dispenser is in the second configuration, the stop member of the stop cover is positioned below the extension member of the front cover.

4. The dispenser of claim 1, wherein the material of the stub roll comprises paper towel.

5. The dispenser of claim 1, wherein, when the dispenser is in the first configuration, the stop member of the stop cover prevents the front cover from pivoting toward a drum of the dispenser.

6. The dispenser of claim 1, wherein the plurality of channels are not on a roller.

7. The dispenser of claim 1, wherein each of the plurality of channels comprises a width that is less than or equal to about ¼ inch.

8. The dispenser of claim 1, wherein the front cover comprises a first end pivotably coupled to the frame and a second end comprising the extension member, and wherein a portion of the front cover is curved to correspond to a curvature of a drum of the dispenser.

9. The dispenser of claim 8, wherein, when the dispenser is in the first configuration, a sheet of the material of the main roll is positioned between the curved portion of the front cover and the drum of the dispenser.

10. A combination comprising the dispenser of claim 1 and at least one of the main roll and the stub roll.

11. A dispenser configured to enable dispensing of one or more sheets of material, the dispenser comprising:

a main roll compartment configured to hold a main roll;

a stub roll compartment configured to hold a stub roll, wherein the dispenser is configured to transition from a first configuration in which the dispenser is configured to enable dispensing of material from the stub roll to a second configuration in which the dispenser is configured to enable dispensing of material from the main roll, and wherein the material of the stub roll is engaged by a drum of the dispenser when the dispenser is in the first configuration, and wherein the material of the main roll is engaged by the drum when the dispenser is in the second configuration;

a front cover comprising an extension member, the front cover having a first position when the dispenser is in the first configuration and a second position when the dispenser is in the second configuration, wherein the front cover is configured to operably position the material of the main roll to engage the drum when in the second position;

a stop cover, wherein, when the dispenser is in the first configuration:

a first portion of the stop cover is supported by the material of the stub roll; and a second portion of the stop cover inhibits the front cover from moving to the second position, the second portion of the stop cover spaced from the first portion of the stop cover and spaced from the material of the stub roll;

wherein the dispenser is configured to transition from the first configuration to the second configuration in response to exhaustion of the material of the stub roll; and wherein when the dispenser is in the first configuration:

the second portion of the stop cover provides a physical interference by contacting the extension member of the front cover, thereby inhibiting the front cover from moving to the second position; and the extension member does not contact the material of the main roll.

12. The dispenser of claim 11, wherein, when the dispenser is in the first configuration, the front cover applies substantially no load on the material of the stub roll.

13. The dispenser of claim 11, wherein, when the dispenser is in the second configuration, the second portion of the stop cover is positioned below the extension member of the front cover.

14. The dispenser of claim 11, wherein the extension member comprises a first end connected to a portion of the front cover, a second end opposite the first end, and a length extending between the first and second ends, and wherein the second portion of the stop cover contacts the second end of the extension member when the dispenser is in the first configuration.

15. The dispenser of claim 11, wherein the second portion of the stop cover comprises a stop member having a first end connected to a portion of the stop cover, a second end opposite the first end, and a length extending between the first and second ends, and wherein the second end of the stop member contacts the extension member when the dispenser is in the first configuration.

16. The dispenser of claim 11, further comprising a frame, wherein a portion of the frame is configured to support the material of the stub roll when the dispenser is in the first configuration.

17. The dispenser of claim 16, wherein:

the front cover comprises a first end movably coupled to the frame and a second end comprising the extension member, and wherein a portion of the front cover is curved to correspond to a curvature of the drum of the dispenser; and when the dispenser is in the first configuration, the material of the main roll is positioned between the curved portion of the front cover and the drum of the dispenser.

18. The dispenser of claim 16, wherein:

the frame comprises at least one channel;

the first portion of said stop cover comprises at least one finger;

when the dispenser is in the first configuration, the at least one finger is supported by the material of the stub roll over the at least one channel of the frame; and when said dispenser is in the second configuration, the at least one finger is positioned at least partially within said at least one channel of said frame.

19. The dispenser of claim 18, wherein the at least one channel is not on a roller.

20. A combination comprising the dispenser of claim 11 and at least one of the main roll and the stub roll.

21. A dispenser configured to enable dispensing of one or more sheets of material and configured to transition from a first configuration to a second configuration, the dispenser comprising:

a main roll compartment configured to hold a main roll;

a stub roll compartment configured to hold a stub roll;

a frame having a plurality of upright portions and a plurality of channels formed by the plurality of upright portions, wherein the plurality of upright portions are configured to support material of the stub roll;

a stop cover pivotably coupled to the frame and having a plurality of fingers and a stop member positioned away from the plurality of fingers, the plurality of fingers aligned with the plurality of channels of the frame; and a front cover pivotably coupled to the frame and having an extension member;

wherein, when the dispenser is in the first configuration:

the extension member of the front cover contacts the stop member of the stop cover;

the plurality of fingers of the stop cover are supported by the material of the stub roll;

the material of the stub roll is supported on the plurality of upright portions of the frame; and the front cover applies substantially no load on the material of the stub roll; and wherein, when the dispenser is in the second configuration:

the plurality of fingers of the stop cover are positioned at least partially within the plurality of channels of the frame;

the stop member is positioned below the extension member; and the dispenser is configured to enable dispensing of material of the main roll.

22. A dispenser configured to enable dispensing of one or more sheets of material and configured to transition from a first configuration to a second configuration, the dispenser comprising:

a main roll compartment configured to hold a main roll;

a stub roll compartment configured to hold a stub roll;

a frame having a plurality of upright portions and a plurality of channels formed by the plurality of upright portions, wherein the plurality of upright portions are configured to support material of the stub roll;

a stop cover pivotably coupled to the frame and having a plurality of fingers and a stop member positioned away from the plurality of fingers, the plurality of fingers aligned with the plurality of channels of the frame; and a front cover pivotably coupled to the frame and having an extension member;

wherein, when the dispenser is in the first configuration:

the extension member of the front cover contacts the stop member of the stop cover;

the plurality of fingers of the stop cover are supported by the material of the stub roll;

the material of the stub roll is supported on the plurality of upright portions of the frame; and the front cover applies substantially no load on the material of the stub roll;

wherein, when the dispenser is in the second configuration:

the plurality of fingers of the stop cover are positioned at least partially within the plurality of channels of the frame; and the dispenser is configured to enable dispensing of material of the main roll; and wherein the plurality of channels are not on a roller.

* * * * *